US005500486A

United States Patent [19]

Smith, III

[11] Patent Number: 5,500,486

[45] Date of Patent: Mar. 19, 1996

[54] PHYSICAL MODEL MUSICAL TONE SYNTHESIS SYSTEM EMPLOYING FILTERED DELAY LOOP

[75] Inventor: Julius O. Smith, III, Palo Alto, Calif.

[73] Assignee: The Board of Trustees of the Leland Stanford Junior University, Palo Alto, Calif.

[21] Appl. No.: 90,783

[22] Filed: Jul. 13, 1993

[51] Int. Cl.[6] ..... G10H 1/06; G10H 7/00

[52] U.S. Cl. ..... 84/622; 84/659

[58] Field of Search ..... 84/600, 622, 661, 84/630, 659, 660

[56] References Cited

U.S. PATENT DOCUMENTS 5,192,825 3/1993 Kunimoto ..... 84/661

5,286,914 2/1994 Kunimoto ..... 84/660 X 5,373,098 12/1994 Kitayama et al. ..... 84/659

*Primary Examiner*—Jonathan Wysocki

*Assistant Examiner*—Jeffrey W. Donels

*Attorney, Agent, or Firm*—Graham & James

[57] ABSTRACT

A tone synthesis system employs a filtered delay loop which is excited by an excitation signal. The excitation signal corresponds to the impulse response of a body filter to the system which is to be simulated. High quality tone synthesis can be achieved without the necessity of providing a complicated body filter.

36 Claims, 8 Drawing Sheets

PHYSICAL MODEL MUSICAL TONE SYNTHESIS SYSTEM EMPLOYING FILTERED DELAY LOOP

BACKGROUND OF THE INVENTION

1. Field of the Invention

The present invention relates to musical tone synthesis techniques. More particularly, the present invention relates to what is known as "physical-modeling synthesis" in which tones are synthesized in accordance with the mechanisms which occur in natural musical instruments. Music synthesis based on a physical model is gaining on currently dominant methods such as "sampling" (or "wave table") synthesis and frequency modulation (FM) synthesis. Such synthesis techniques are particularly useful for simulation of wind instruments and string instruments. By accurately simulating the physical phenomena of sound production in a natural musical instrument, an electronic musical instrument is capable of providing high quality tones.

2. Description of Related Art

In the case of a string instrument, the structure for synthesizing tones typically includes a filtered delay loop, i.e., a closed loop which includes a delay having a length corresponding to one period of the tone to be generated and a filter contained in a closed loop. An excitation signal is introduced into the closed loop and circulates in the loop. A signal may be extracted from the loop as a tone signal. The signal will decay in accordance with the filter characteristics. The filter models losses in the string and possibly at the string termination (e.g., nut and bridge in a guitar).

In an actual stringed instrument, the string is coupled to a resonant body and the vibration of the string excites the resonant body. In order to accurately model a natural musical instrument, therefore, it has been necessary to provide a filter at the output of the filtered delay loop. To obtain high quality sound, it has been necessary to follow the string output by a large and expensive digital filter which simulates the musical instrument body. The excitation signal generally takes the form of white noise or filtered white noise. Alternatively, a physically accurate "pluck" waveform may be provided as an excitation to the closed loop, which results in more accurate plucked string simulation.

A tone synthesis system as described above is illustrated in FIG. 1. A filtered delay loop is formed of a delay element 10 and a low pass filter 12. An excitation source (e.g., a table) 14 provides an excitation signal into the loop via an adder 16. The contents of the excitation table may be automatically read out of a memory table in response to a trigger signal generated in response to, e.g., depression of a key. The excitation signal which is inserted into the filtered delay loop circulates and changes over time due to the filter operation. A signal is extracted from the delay loop and provided to a body filter 18. For high quality instrument synthesis, a complicated and expensive body filter (typically a digital filter) or additional filtered delay loop is required.

The tone synthesis system illustrated in FIG. 1 may be implemented in hardware, although it is somewhat more common to implement the tone generation technique in software utilizing one or more digital signal processing (DSP) chips. The system of FIG. 1 is capable of very high quality tone synthesis. However, it has the drawback of requiring a complex and expensive digital filter which simulates the instrument body.

SUMMARY OF THE INVENTION

The present invention provides a physical model tone synthesis system in which high quality tones can be synthesized without the necessity of an expensive body filter. The body filter can be entirely eliminated and yet tone quality approaching that of a system including a complex body filter can be obtained. The filtered delay loop and body filter are both linear, time-invariant systems. These systems therefore commute, i.e., the body filter can be located before the filtered delay loop to produce an equivalent system. The output of the excitation generator in such a configuration is coupled directly to the body filter. By recognizing that in a plucked or struck string situation the excitation is generally in the form of an impulse, it was determined that the output of the body filter, and thus the excitation applied to the delay loop, will represent the impulse response of the body filter. In the present invention, this impulse response is determined and it is this response which is stored as an aggregate excitation signal. The body filter is thus eliminated, and the aggregate excitation signal is provided directly to the filtered delay loop. Thus, by providing an appropriate excitation signal which corresponds to the body filter impulse response, a high quality sound can be synthesized without requiring an expensive filter.

The excitation generator may be implemented as a single fixed excitation signal or, alternatively, as a plurality of excitations which are combined to form a composite excitation. By controllably weighting each of the plural different excitations, numerous different composite excitations can be provided. In addition, the various excitations can be controlled to vary over time, thus providing significant control capabilities and tone variation despite the use of a fixed set of excitation signals.

BRIEF DESCRIPTION OF THE DRAWINGS

The invention will be described with reference to the accompanying drawings, wherein.

DESCRIPTION OF THE PREFERRED EMBODIMENT

The following is a description of the best presently contemplated mode of carrying out the invention. The description is not to be taken in a limiting sense but is made for the purpose of illustrating the general principles of the invention. It is particularly noted that the invention may be implemented in either hardware form including various delays, filters, etc. or in software form employing appropriate algorithms implemented, e.g., in a DSP.

Figure 1:
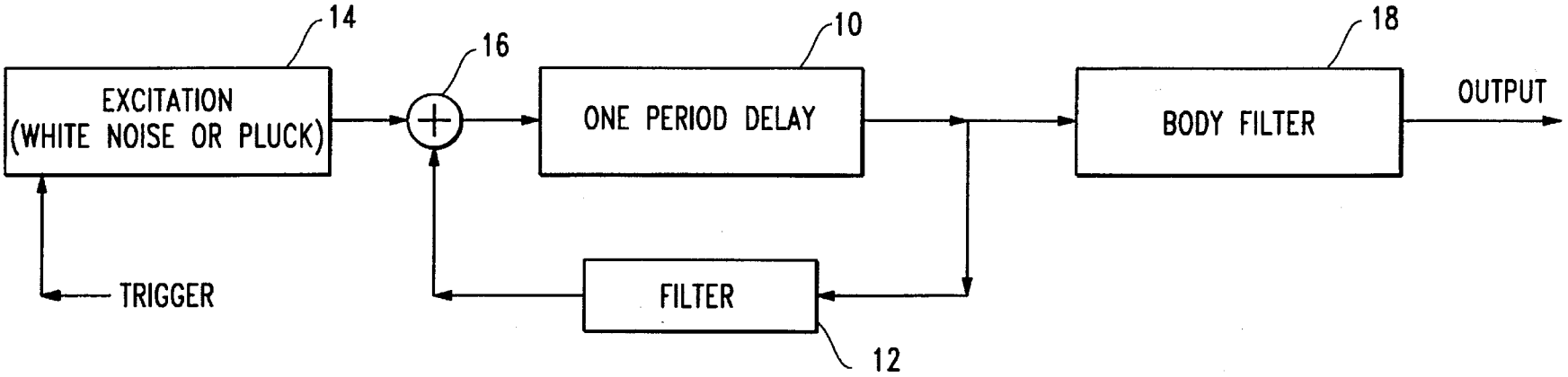
FIG. 1 PRIOR ART
FIG. 1 is a block diagram of a prior art filtered delay loop tone synthesis system employing a body filter.
Figure 2:
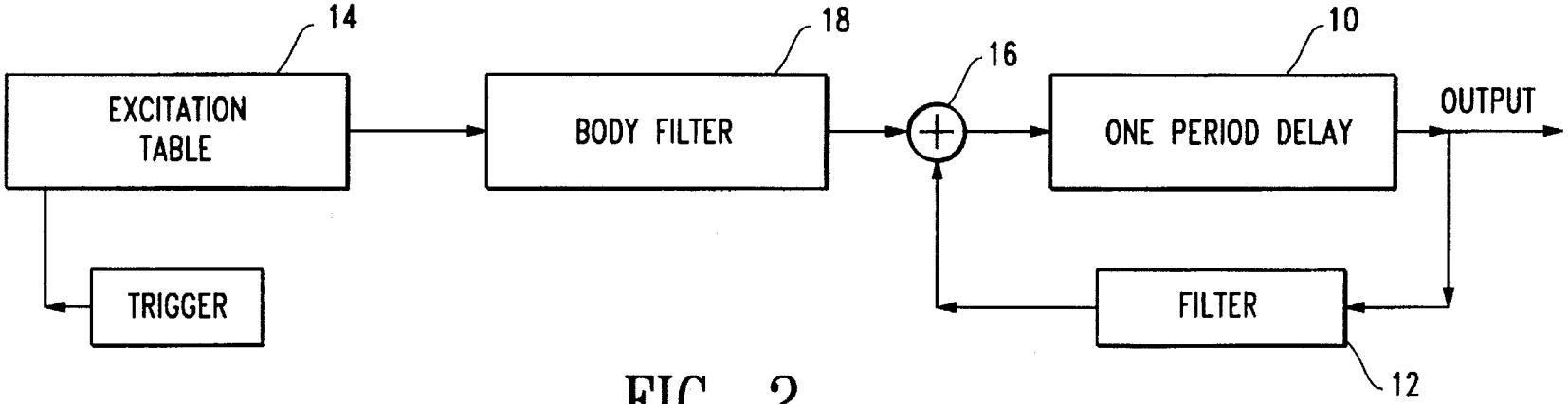
FIG. 2 is a block diagram of a tone synthesis system in which the filtered delay loop and body filter have been commuted.

FIG. 1 illustrates a prior art filtered delay loop tone generation system incorporating a filtered delay section including a delay 10 and filter 12, and a digital filter 18 to simulate the resonating body of a natural musical instrument such as a guitar. An excitation source 14 provides an excitation signal into the delay loop. The inventor has recognized that the filtered delay loop and the body filter are essentially both linear, time-invariant systems. Because of this, the systems commute, i.e., their order can be reversed without altering the resultant tone. This is illustrated in FIG. 2, where the body filter 18 is shown ahead of the filtered delay loop. This modification in and of itself does not provide any significant advantage, since the overall processing requirements remain the same. However, if the string simulation variable is chosen to be transverse acceleration waves, an ideal string pluck becomes an impulse, as is shown in the art. In this case, the output of the excitation table to pluck the string is a single non-zero sample for each pluck, preceded and followed by zeros, i.e., an impulse. As a result, what excites the filtered delay loop is the impulse response of the body filter. Since the body filter does not change over the course of a note, the body impulse response is fixed. The present invention takes advantage of this fact to completely eliminate the need for a body filter. Instead of providing an excitation table providing an impulse and passing it through a body filter, an excitation table is loaded with an aggregate excitation representing the impulse response of a desired body filter. The very expensive body filter (or filter processing in a DSP system) which is otherwise needed to simulate connection of the string to a resonating instrument body or other coupled structure can thus be eliminated.

Figure 3:
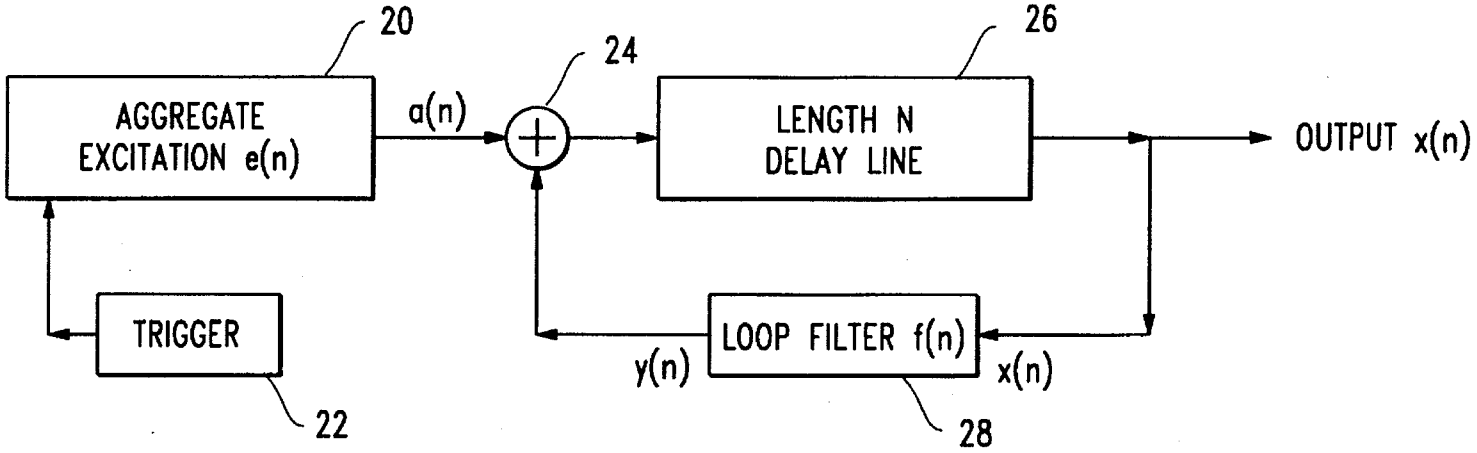
FIG. 3 is a block diagram of the present invention in which an aggregate excitation signal corresponding to the impulse response of the body filter is provided.

FIG. 3 illustrates the configuration of the tone synthesis of the present invention. The system includes an excitation source which in the embodiment shown is a table 20 which provides an aggregate excitation e(n) in response to a trigger (e.g., key-on) signal 22. The aggregate excitation signal is provided to a filtered delay loop via adder 24. The delay loop includes a variable length delay line 26 and a loop filter 28. The output of the delay line 26 is extracted as a tone synthesis output x(n) and is also provided back to the loop filter 28 (multiple outputs may be extracted as is known in the art). The output of the loop filter 28 y(n) is fed back to the adder 24. The length N of the delay line provides a coarse pitch control. The loop filter 28 provides fine pitch control and determines the change in tone throughout the course of a played note. The excitation signal determines the initial spectral content of the tone, including details attributable to a body filter as well as the physical excitation, such as where a pick was located in the case of a plucked guitar simulation.

The loop filter impulse response (IR), expressed as f(n), n equals 0, 1, 2, . . . , Nf-1 is determined by the losses in the vibrating string associated with bending and air drag, and the losses due to coupling of the string to the instrument body. Determination of the specific loop filter characteristics is known and will not be discussed in detail. The impulse response f(n) may be obtained from equations of basic physics relating to theoretical losses in the string and body coupling. The string material, string tension and diameter may be employed to obtain theoretical predictions of string loss per unit length. Losses at body coupling points, e.g., a guitar bridge, may be predicted from bridge geometry and instrument body resonances. Alternatively, f(n) may be obtained from physical measurements on an actual instrument string. Combinations of predictions based upon equations and actual physical measurements may also be employed.

Figure 4:
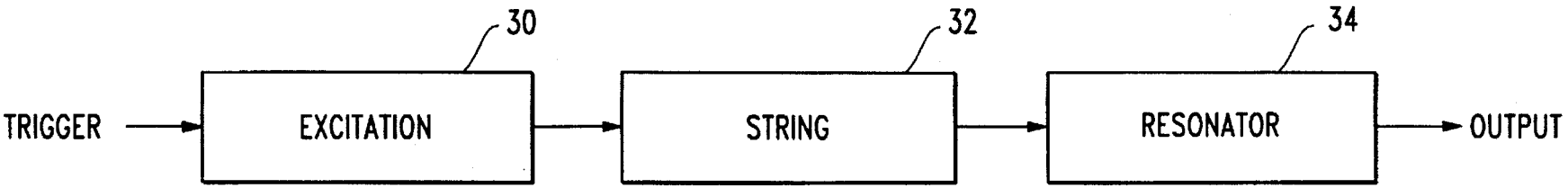
FIG. 4 is a block diagram of the sound generation mechanism of a guitar.
Figure 5:
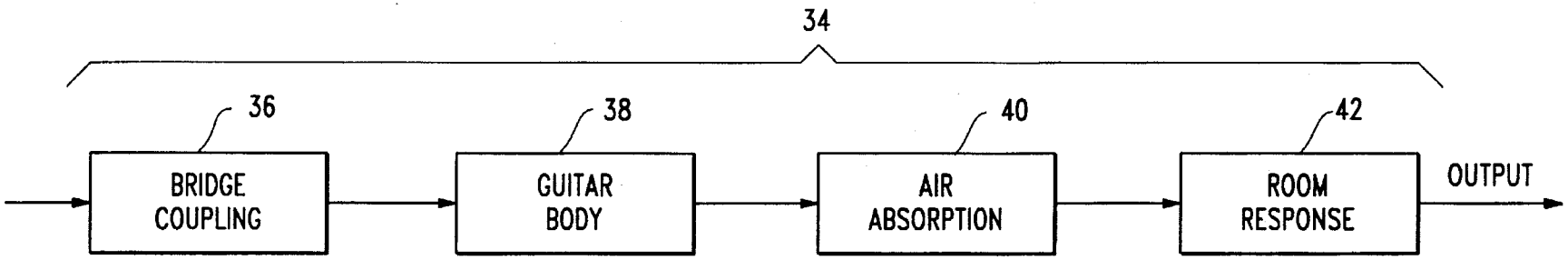
FIG. 5 is a block diagram of the sound generation of a guitar and surrounding space.
Figure 6:
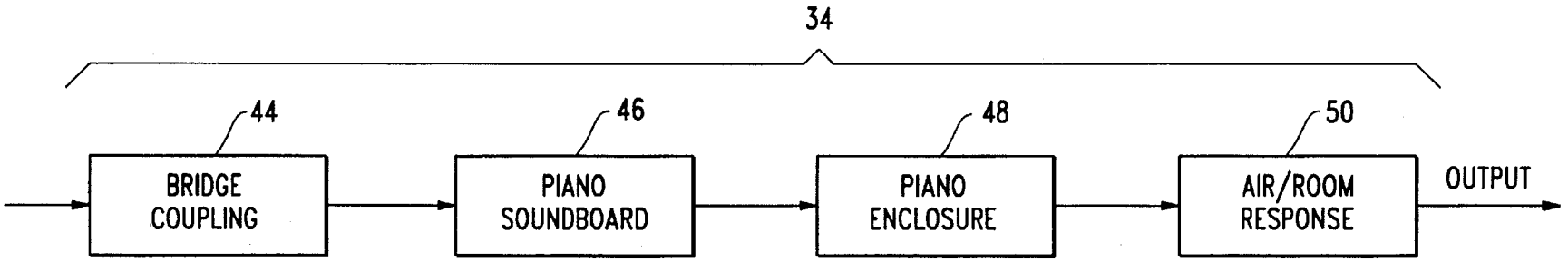
FIG. 6 is a block diagram of the sound generation mechanism of a piano including the surrounding space.

A number of different methods may be employed to determine the excitation signal e(n). The excitation signal e(n) is determined by both the nature of the physical string excitation and the response of the instrument to the point of excitation by the string. In the case of a guitar, the excitation to the body occurs at the bridge of the guitar. FIG. 4 illustrates a physical block diagram of a guitar, including an excitation 30 applied to a string 32 which in turn excites a resonator (the guitar body) 34. In a physical system, a resonator is determined by the choice of output signal. A typical example would be to choose the output signal at a point a few feet away from the top plate of a guitar body. In practice, such a signal can be measured using a microphone held at a desired output point and recording the response at that point to the striking of the guitar bridge with a force hammer. It should be noted that the resonator as defined includes the transmission characteristics of air as well as the resonance characteristics of the guitar body itself. If the output point is chosen far from the guitar in a reverberant room, it will also include resonance characteristics of the room in which the measurement is taken. This aggregate nature of the resonator is depicted in FIG. 5. The overall resonator 34 includes the bridge coupling 36, guitar body 38, air absorption 40 and room response 42. In general, it is desirable to choose the output relatively close to the guitar so as to keep the resonator impulse response as short as possible. However, the generality afforded by being able to combine all downstream filtering into a single resonator is an important feature of the invention. This is more obvious in the case of piano modeling, in which both the sound board and the piano enclosure may be combined in one resonator. This is illustrated in FIG. 6. The overall resonator 34 is formed of a bridge coupling 44, piano sound board 46, piano enclosure 48 and air/room response 50.

Figure 7:
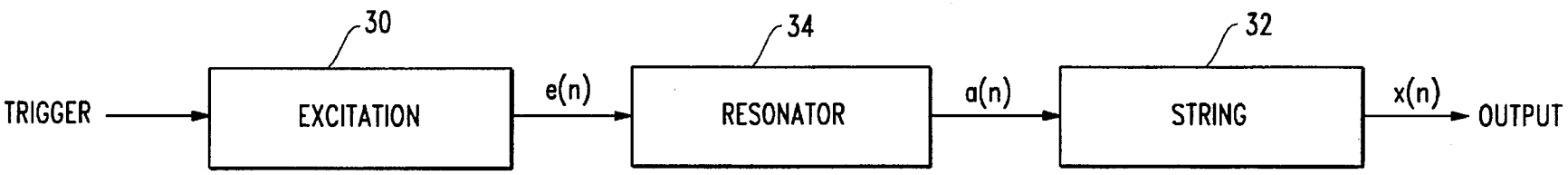
FIG. 7 is a block diagram of a sound generator illustrating an equivalent sound generator mechanism in which a resonator is placed before the string.

The only technical requirement on the components of the resonator is that they be linear and time-invariant. As discussed above, these two properties imply that they are commutative, i.e., they may be implemented in any order. In the case where the string is also linear and time-invariant, the resonator and the string may be commuted as illustrated in FIG. 7. The string is actually the least linear element of almost any stringed musical instrument; however, it is very close to linear, with the main effect of non-linearity being a slight increase of the fundamental vibration frequency with amplitude. For commuting purposes, the string can be considered sufficiently close to linear. The string is also time varying in the presence of vibrato, but this too is a second order effect. While the result of commuting a slowly time-varying string and resonator is not identical mathematically, it will sound essentially the same.

Figure 8:
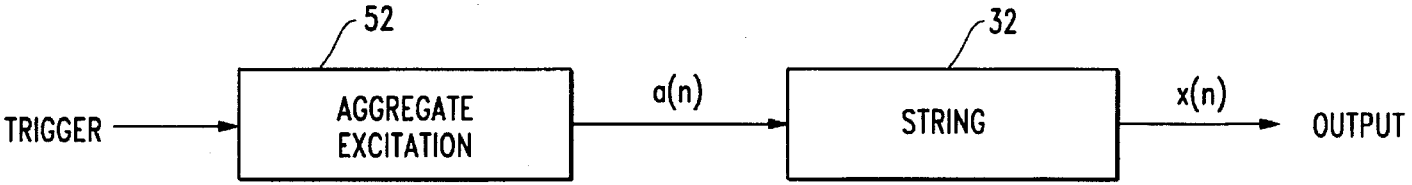
FIG. 8 is a block diagram illustrating the sound generation mechanism in which the response of the resonator to a particular excitation is employed as an aggregate excitation.

Following commutation of the string and resonator as illustrated in FIG. 7, the next step is to combine the excitation and resonator into an aggregate excitation as illustrated in FIG. 8. The aggregate excitation 52 is determined to provide an output a(n) which is essentially the same as the output of the resonator 34 in FIG. 7. First, the nature of the excitation must be specified. The simplest example is an impulse signal. Physically, this would be the most appropriate choice when the string is used to model acceleration waves. In this case, an ideal pluck gives rise to an impulse of acceleration input to the string. In this simple case, the aggregate excitation 52 is simply the sampled impulse response of a chosen resonator. In more elaborate cases, given any excitation signal e(n) and resonator impulse response r(n), the equivalent aggregate excitation signal a(n) is given by the convolution of e(n) and r(n), set forth in Equation (1) below:

$$a(n) = (e*r)(n) = \sum_{m=0}^{n} e(m)r(n-m) \tag{1}$$

If the aggregate excitation is long, it may be desirable to shorten it by some technique. To accomplish this, it is useful to first convert the signal a(n) to minimum phase as described in various references on signal processing. This will provide the maximum shortening consistent with the original magnitude spectrum. Secondly, a(n) can be windowed using the right portion of any of various window functions typically used in spectrum analysis. One useful window is the exponential window, since it has the effect of increasing the damping of the resonator in a uniform manner.

Figure 9:
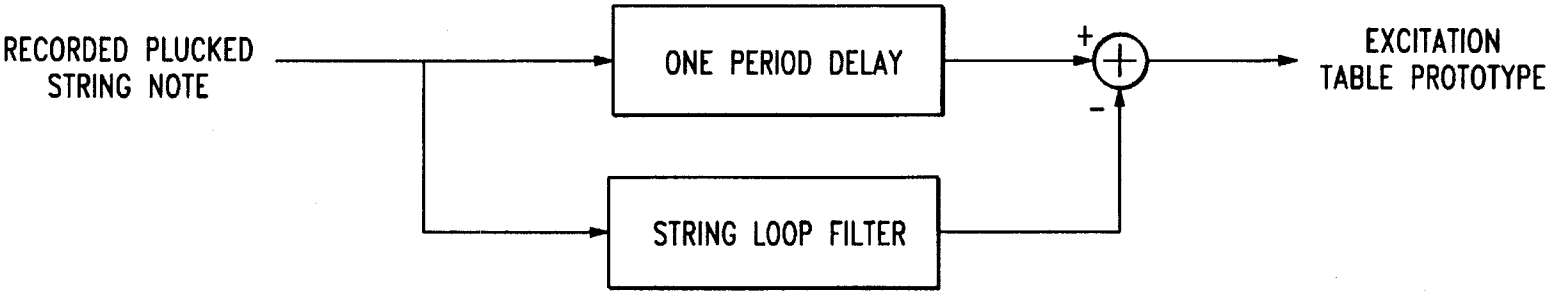
FIG. 9 is a block diagram illustrating an inverse filtering method of determining an excitation signal.

An excitation signal may also be determined by recording a sound from an instrument (e.g., a plucked string sound) and inverse filtering to filter out the contribution of the string loop. This is illustrated in FIG. 9 in which a string loop filter is determined by one of various methods and included in an inverse filter. The resultant output includes components corresponding to the pluck and the body filter, and can be used as an excitation (or as the basis to derive an excitation after modification).

Figure 10:
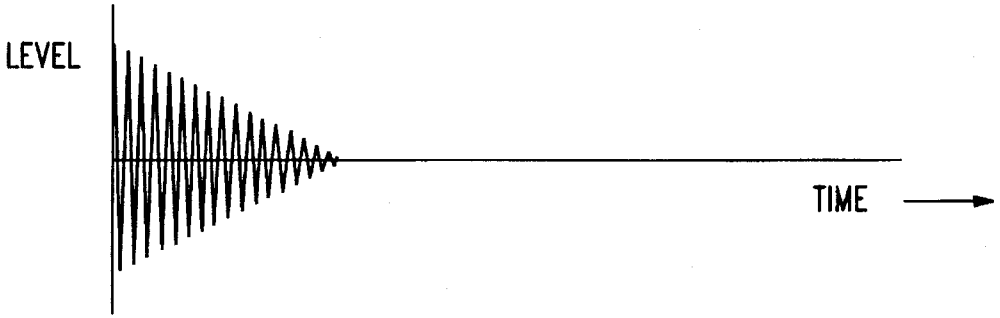
FIG. 10 is an illustration of an example of an excitation signal corresponding to the impulse response of a body filter.

FIG. 10 illustrates an impulse response of a typical body filter of a natural musical instrument. Essentially, the impulse response is a damped oscillatory waveform. It is a response such as this which will be stored as the aggregate excitation signal in the most simple case in which the excitation is an impulse. In other cases where the excitation is other than an impulse, the aggregate excitation will be a convolution result as described above. Since the convolution is with an impulse response, the convolution result will in every case terminate with a damped oscillatory waveshape. However, it should be appreciated that various shortening techniques may result in an excitation signal which has other than a damped oscillatory shape. Such shortened excitations are derived from (and provide similar results to) the original impulse response.

Figure 12:
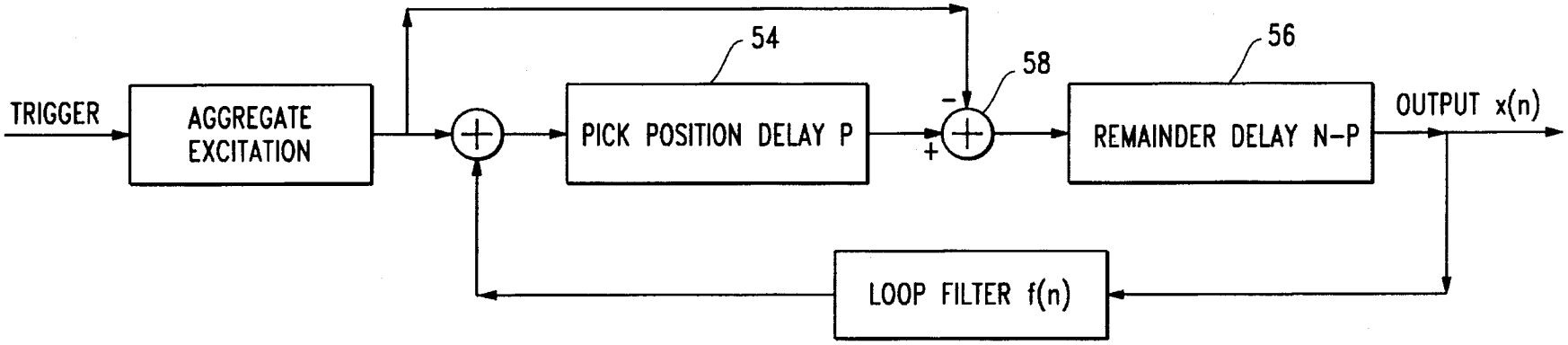
FIG. 12 is a block diagram of a tone generation system permitting simulation of variation of pick position.

The tone synthesis system can be employed to simulate different pick positions, i.e., inputting of an excitation at different points along a string. By exciting the string simultaneously at two different positions along the delay line and summing into the existing contents of the delay loop at that point, the illusion of a particular pick position on a string is simulated. This is illustrated in FIG. 12, where the delay is divided into two delays 54 and 56 and an adder 58 is inserted between the delays. In general, the ratio of the pick position delay to the total loop delay equals the ratio of the pick position to string length. The total delay length is N, the desired tonal period corresponding to the selected pitch (minus the delay of the loop filter).

Figure 13:
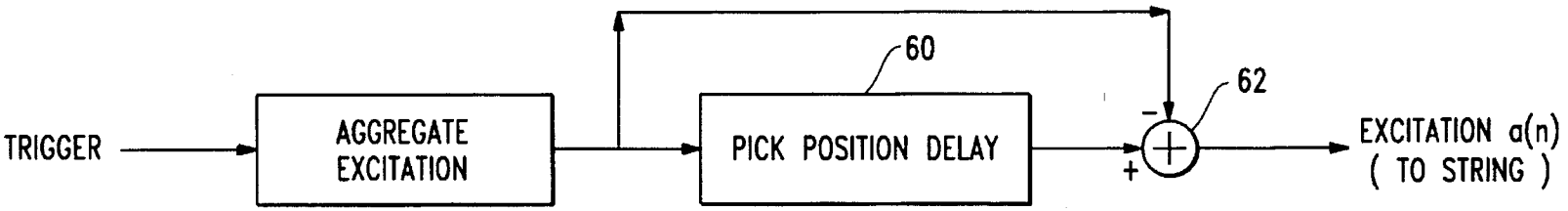
FIG. 13 is a block diagram illustrating an equivalent system to provide pick position variation.

A related technique is to delay the excitation and sum it with the non-delayed excitation to achieve essentially the same effect. This is illustrated in FIG. 13 in which a separate pick position delay 60 and adder 62 are provided. The pick position delay can be varied to control the effective pluck point of the string.

Figure 14:
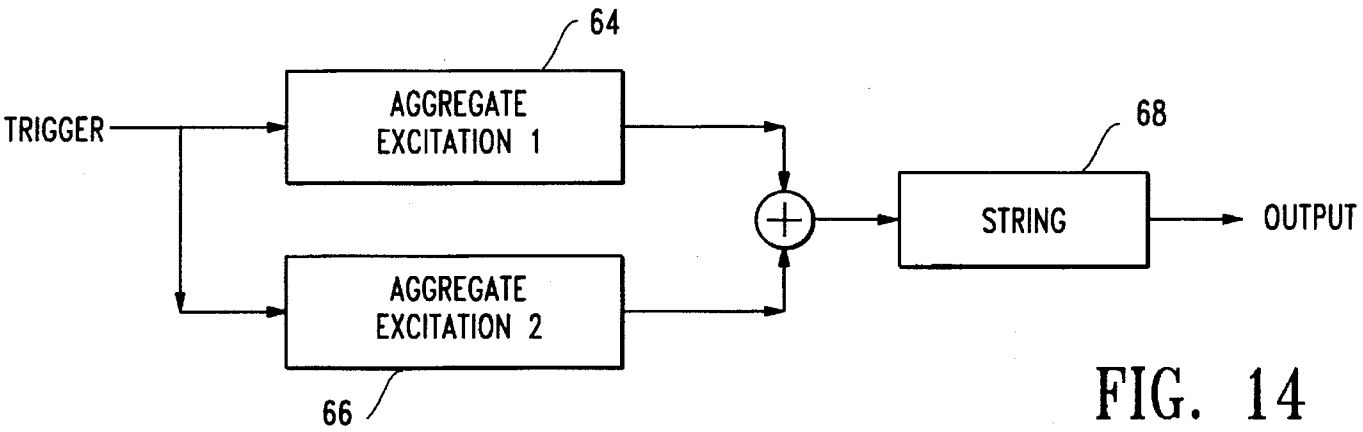
FIG. 14 is a block diagram of a system employing two excitation tables which are scaled and added together to produce a final excitation.

The tone synthesis system of the present invention may be modified to provide multiple excitation signals in order to achieve the effect of multiple radiation points of natural musical instruments and other effects. When listening to musical instruments made of wood and metal, the listener receives signals from many radiating surfaces on the instrument. This results in different signals reaching both ears. Furthermore, when the player moves the instrument, or when the listener moves his or her head, the mixture of sound radiation from the instrument changes dynamically. To address these natural phenomena, it is helpful to support multiple output signals corresponding to different output signals in a natural environment. In the present invention, this can be approximated simply by providing multiple aggregate excitation signals, each having different content reflecting different body filters or different overall resonant systems. This is illustrated in FIG. 14 in which aggregate excitation signals 64 and 66 are provided and are applied to a single string delay loop 68 (separate string loops can be provided if separate outputs are desired). Although only two aggregate excitations are illustrated, any number of excitations may be provided to further simulate different output points cross-fade. Interpolation between two or more tables may also be employed.

Figure 11A:
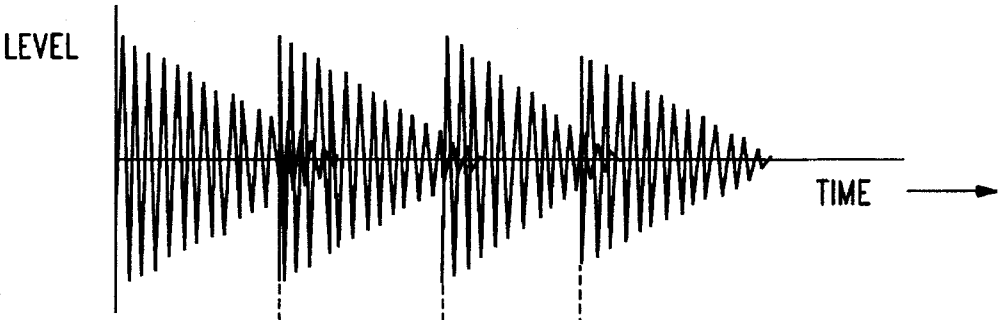
FIGS. 11A and 11B are illustrations of repetitive provision of an excitation signal in order to achieve sustained tone generation.
Figure 11B:
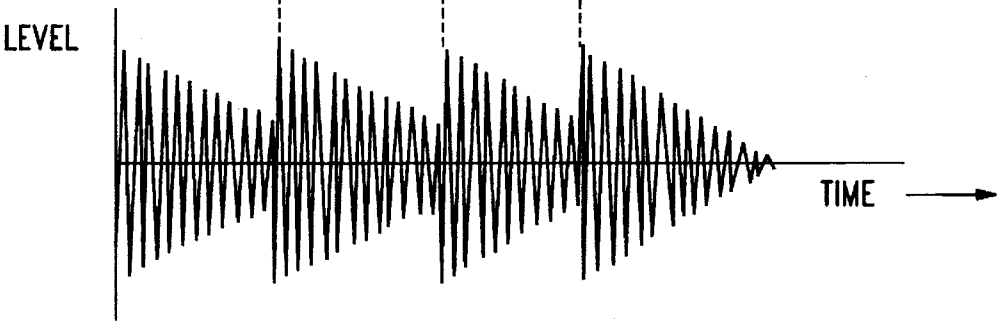

An important variation in the tone synthesis system is to play out the excitation table quasi-periodically. Instead of a single trigger to initiate a plucked string tone, the trigger is applied periodically (or near periodically, allowing for vibrato). In this instance, the amplitude of the excitation can be reduced (e.g., by right shifting table output values or imparting an amplitude envelope to the table output) to provide an appropriate output level. This technique is capable of extremely high quality bowed string simulation. Two variants are possible when a trigger occurs while the excitation table is still playing out. First, the excitation table may be restarted from the beginning, thus cutting off the playback in progress. This is illustrated in FIG. 11B. Alternatively, the start of a new excitation playback can be overlapped with the playback in progress as illustrated in FIG. 11A. This variant requires a separate incrementing pointer and adder for each instance of the table playback and thus is somewhat more complex. However, it is preferred from a quality standpoint.

Figure 15:
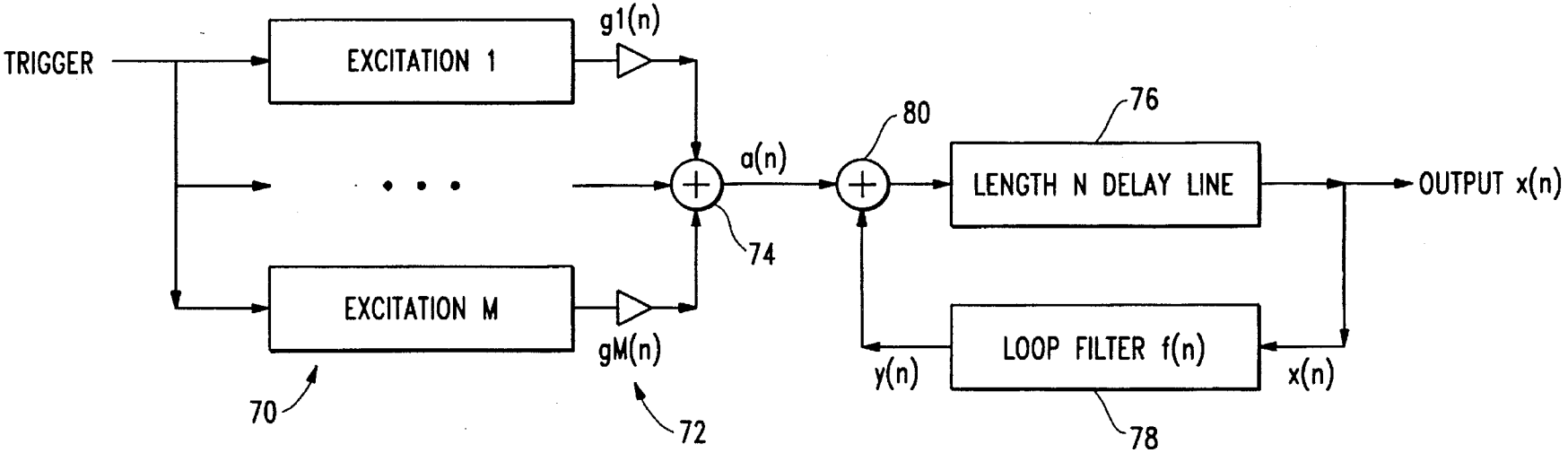
FIG. 15 is a block diagram of a tone synthesis system incorporating a time varying mixed excitation generator.

In addition to providing a mixed excitation as in FIG. 14, a useful variation is to provide plural excitations (tables or otherwise) and provide gain control for each excitation which may be varied over time. This is illustrated in FIG. 15 in which excitation generators 70 generate M excitation signals. Each excitation output has an associated gain control element 72, which may be varied over time. The outputs of the gain control elements are combined by means of an adder 74 to provide an aggregate excitation signal a(n). This signal is provided to the delay loop including delay line 76 and loop filter 78 via an adder 80. The provision of gain control for each of the excitations provides a means for synthesizing a wide range of excitations as a time-varying linear combination of a fixed set of excitations. That is, each excitation signal is fixed but its relative contribution to the overall excitation signal which is provided to the delay loop may be controlled by controlling the relative gain of each excitation signal. The gains may be set at a particular value and held for the duration of a note, or they may be varied over time to alter the character of the tone being generated, in addition to the alteration provided by the filtered delay loop itself.

In a free oscillation, e.g., a plucked tone, the gains gi(n) would typically be fixed, such that only one linear combination of excitations would be used. In a driven oscillation, e.g., a bowed string, the gains can be varied over time to alter the character of the tone. This may be accomplished by providing a smoothly varying envelope for each excitation to control the relative contributions of the different excitations. The variation over time achieved by altering the excitation is in addition to the time variation achieved in the filtered delay loop.

The nature of the various excitation tables may be selected to maximize the number of useful variations available from a fixed set of tables. A set of excitations may, for example, include a number of wave tables stored in ROM plus a filtered noise generator. The wave tables may provide various aggregate excitation signals taking into account different body filters, or may be based upon principal components analysis in which principal components (e.g. frequency) of overall desired excitations are separately provided in different wave tables and variably combined. This is similar to well known Fourier synthesis techniques used for standard tone generation (but not for excitation signal generation for delay loop tone synthesis).

The tone synthesis system illustrated in FIG. 15 is useful for simulating bowed string sounds. Generally, accurate simulation of such sounds requires a delay loop having a non-linear junction for receiving an excitation signal and a signal circulating in the loop and returning a signal in accordance with a non-linear function. The synthesis system of FIG. 15 does not require the complexity of a non-linear junction yet can provide a good approximation of a bowed string instrument by employing only a filtered delay loop and time varying excitation signal. In this regard, it should be noted that each individual excitation signal in itself is generally time varying but of a fixed relatively short duration. For a sustained tone such as a bowed string simulation, each excitation will be repeated plural times and time variation of the relative strengths of each excitation provides desirable tonal variation.

Figure 16:
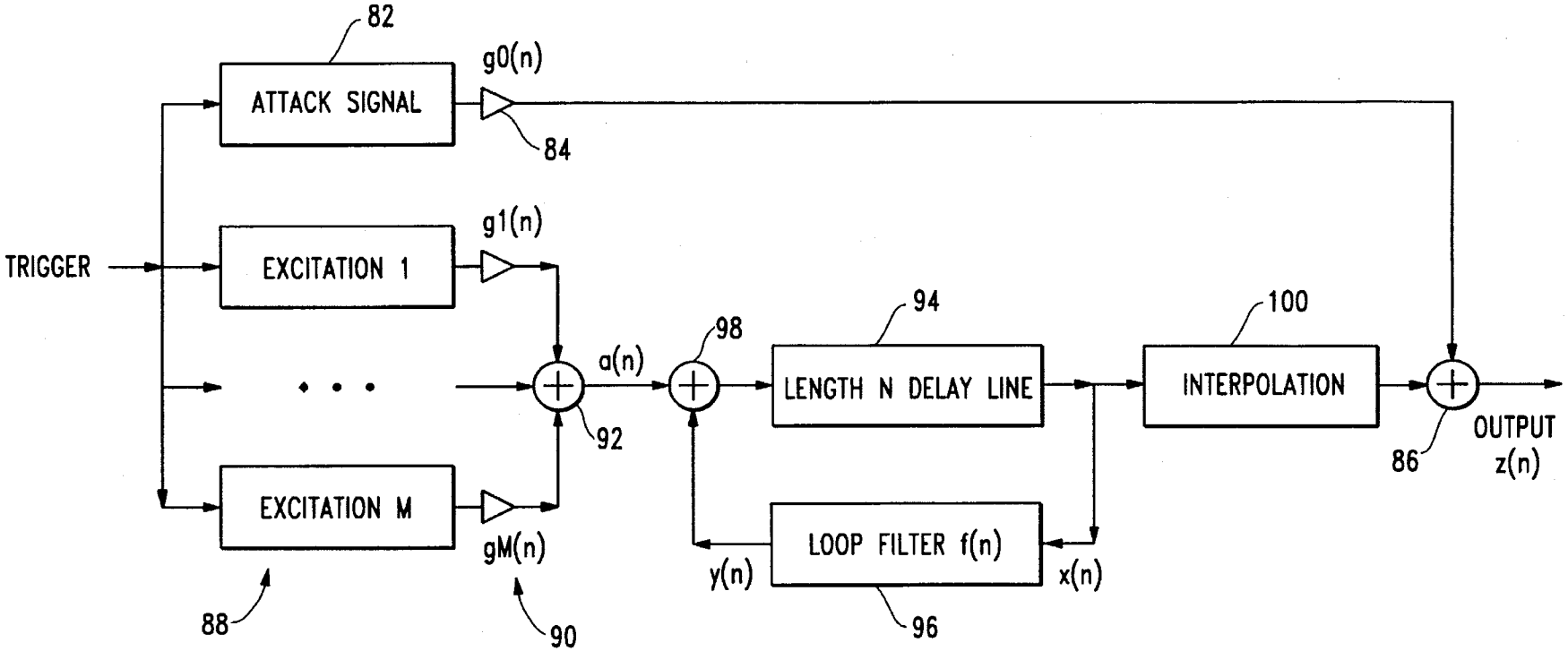
FIG. 16 is a block diagram of a tone synthesis system incorporating an excitation generator for providing an attack component outside of the delay loop.

An additional modification which provides significant computational advantages is illustrated in FIG. 16. The initial attack portion of a tone generally includes significant high-frequency information. In order to properly synthesize the attack portion in a conventional filtered delay loop, the loop filter sampling rate must be maintained relatively high. This is not the case with respect to remaining portions of the synthesized tone, which have significantly fewer high frequency components. The present invention significantly reduces computational requirements by providing a separate attack signal as one of the excitation signals and routing it around the filtered delay loop as illustrated in FIG. 16. The attack signal is a high-frequency short duration signal (e.g., 100 msec) which is read out in response to the trigger signal in parallel with additional excitation signals. In FIG. 16, the attack signal is provided at 82, gain control by an amplifier at 84 and provided to an output summing junction 86. Additional excitation tables provided at 88 are appropriately weighted at 90 and summed at 92 to provide a composite excitation signal e(n) to be input into a filtered delay loop including delay line 94, loop filter 96 and adder 98. Significantly, the sampling rate in the loop filter may be quite low in view of the lack of necessity to process high-frequency components. For example, in a reduced-cost implementation for a low-pitched note such as the low E on a guitar, excitations which enter the string loop may be restricted to below 1.5 KHz, and the first 100 msec of a recorded note high passed at 1.5 KHz may be used for the attack signal. A sampling rate of 3 KHz may be employed for the delay loop. The output signal of the loop may be up-sampled to 22 KHz by means of an interpolation circuit 100 and added to the attack signal (which is also provided at a 22 KHz sample rate). The composite output signal z(n) includes both higher and lower frequency components which are desired, yet the processing of the delay loop is substantially simplified. The sampling rate of the string loop may be controlled as a function of pitch.

The synthesis technique of the present invention can also be extended to tonal percussion in instruments, such as vibraphone and other percussion instruments such as tom-toms, marimba, glockenspiel, etc. which have a small number of exponentially decaying resonant modes. In these cases, plural filtered delay loops can be summed to provide the most important resonant modes, approximating them as a sum of nearly harmonic modal series. The technique can also be applied to wind instruments. The excitation table in this case provides the impulse response from inside of the tube of the instrument to outside the tone holes and bell. Due to the lack of a non-linear junction giving interaction between the sound waveform and the excitation (and which is typically used in physical simulation of wind instruments), natural articulations are difficult to obtain. However, the technique provides a simple, reduced cost implementation.

In summary, by providing an excitation signal corresponding to a triggered impulse response, with optional preprocessing of the impulse response, high quality tones can be synthesized without the need for expensive and complex body filters. The characteristics of a resonant system downstream of a vibrating element such as a string may be provided for by properly deriving an excitation signal which takes into account the impulse response of the downstream resonance system. The tone synthesis technique is greatly simplified as compared to systems requiring complex body filters.

What is claimed is:

1. A tone synthesis system for synthesizing a tone simulating a tone produced by a vibrating element in conjunction with a resonant member to which the vibrating element is acoustically coupled, comprising:

a closed loop including an input for receiving an excitation signal, a delay for delaying a signal circulating in the loop, and a filter for filtering a signal circulating in the loop and an output from the closed loop for providing a synthesized tone, wherein the amount of delay in the loop corresponds to the pitch of a tone to be synthesized; and excitation means for providing an excitation signal to the input, said excitation signal including a portion thereof corresponding to an impulse response of said resonant member.

2. A tone synthesis system as in claim 1 wherein the excitation means comprises at least one table storing value corresponding to said impulse response and trigger means for reading table values to initiate production of a tone.

3. A tone synthesis system as in claim 2 wherein the excitation means further includes a noise generator whose output is combined with the output of said at least one table.

4. A tone synthesis system as in claim 2 including plural tables storing values corresponding to different impulse responses and means for interpolating between plural table values based upon a performance parameter to provide the excitation signal.

5. A tone synthesizer as in claim 4 wherein the vibrating element is a string which is plucked or struck to initiate vibrations in the resonant member.

6. A tone synthesis system as in claim 1, wherein said portion of said excitation signal corresponding to an impulse response of said resonant member comprises a damped oscillatory waveform.

7. A tone synthesis system for synthesizing a tone simulating a tone produced by a vibrating element which excites a resonant system comprising:

a closed loop including an input for receiving an excitation signal, a delay for delaying a signal circulating in the loop, a filter for filtering a signal circulating in the loop and an output for providing a synthesized tone, wherein the amount of delay in the loop corresponds to the pitch of a tone to be synthesized; and excitation means for providing an excitation signal to the input, the excitation signal having a form corresponding to a response of the resonant system to an excitation.

8. A tone synthesis system as in claim 7 wherein the excitation means comprises a table whose values are read out in response to a trigger signal.

9. A tone synthesis system as in claim 8 wherein the excitation signal has a decaying oscillatory form.

10. A tone synthesis system as in claim 8 wherein the excitation signal is a phase-modified signal derived from a response of the resonant system to an excitation.

11. A tone synthesis system as in claim 8 wherein the table is read out repeatedly to provide a sustained tone.

12. A tone synthesis system as in claim 9 wherein the excitation is an impulse and the excitation signal has a form corresponding to an impulse response of the resonant system.

13. A tone synthesis system as in claim 11 wherein the excitation signal is comprised of a convolution of said impulse response and an arbitrary excitation function.

14. A tone synthesis system comprising:

a closed loop including an input for receiving an excitation signal, a delay for delaying a signal circulating in the loop, a filter for filtering a signal circulating in the loop and an output for providing a synthesized tone, wherein the amount of delay in the loop corresponds to the pitch of a tone to be synthesized; and means for providing said excitation signal having a decaying oscillatory form.

15. A tone synthesis system as in claim 14 wherein the means for providing an excitation signal comprises table means for storing the excitation signal.

16. A tone synthesis system as in claim 15 including means for providing a trigger signal to the table means to cause the table values to be read out.

17. A tone synthesis system as in claim 14 including at least one additional closed loop having at least one filter or delay characteristic different from the other closed loop(s), wherein the excitation signal is applied to each closed loop.

18. A tone synthesis system as in claim 14 wherein the closed loop includes two inputs for inputting the excitation signal at two different points in the closed loop separated by a predetermined delay amount.

19. A tone synthesis system as in claim 14 wherein the excitation means includes means for providing a basic excitation signal, means for delaying the basic excitation signal by a predetermined amount, and means for summing the delayed basic excitation signal and non-delayed basic excitation signal and providing the sum to the closed loop.

20. A tone synthesis system as in claim 14 further including a second excitation means for providing a second excitation signal in parallel with the excitation signal and means for summing the excitation signal and second excitation signal to provide a resultant excitation signal to the closed loop.

21. A tone synthesis system as in claim 14 further including a second excitation means for providing a second excitation signal in parallel with the excitation signal and means for interpolating between the parallel signals to provide an interpolated excitation signal to the closed loop.

22. A tone synthesis system as in claim 21 wherein the means for interpolating can variably interpolate between the parallel signals in response to a control signal and further including means for providing the control signal.

23. A tone synthesis system as in claim 22 wherein the closed loop corresponds to a plucked string and wherein the control signal represents a position at which the string is plucked.

24. A tone synthesis system as in claim 15 including means for automatically repeatedly triggering reading of the excitation signal from the table means to provide a sustained tone.

25. A tone synthesis system as in claim 24 wherein said triggering is periodic.

26. A tone synthesis system as in claim 24 wherein said triggering is near periodic.

27. A tone synthesis system as in claim 24 including means for continuing reading of any remaining portion of the excitation signal upon each triggering in parallel with renewed reading of the excitation signal and summing readings to form the excitation signal.

28. A tone synthesis system comprising:

a closed loop including an input for receiving an excitation signal, a delay for delaying a signal circulating in the loop, a filter for filtering a signal circulating in the loop and an output for providing a signal from the loop as a synthesized tone;

excitation means for providing an excitation signal to the input of the closed loop in response to a trigger signal, the excitation means including plural excitation tables each storing a different excitation signal and means for mixing the outputs of the excitation tables in accordance with different weightings to provide a composite excitation signal.

29. A tone synthesis system as in claim 28 wherein the excitation means includes means for varying the respective weightings over time.

30. A tone synthesis system as in claim 28 wherein the excitation means includes plural tables each storing a signal representing a different frequency component, whereby different frequency components may be mixed at different weightings to provide a desired excitation.

31. A tone synthesis system comprising:

a closed loop including an input for receiving an excitation signal, a delay for delaying a signal circulating in the loop, a filter for filtering a signal circulating in the loop and an output for providing a signal from the loop;

excitation means for providing an excitation signal to the input of the closed loop in response to a trigger signal;

attack means for providing an attack signal, representing an initial portion of a tone to be synthesized, in response to the trigger signal; and means for adding the attack signal and the output of the closed loop to form a synthesized tone.

32. A tone synthesis system as in claim 31 wherein the excitation means and attack means are each comprised of a table storing the excitation signal and attack signal, respectively.

33. A tone synthesis system as in claim 31 wherein the system is a digital system in which the attack means provides the attack signal at a first sampling rate and the closed loop provides samples at its output at a second sampling rate which is less than the first sampling rate, wherein the system further comprises resampling means for resampling the output of the closed loop to provide samples at the first sampling rate, wherein the output of the resampling means is provided to the adding means.

34. A tone synthesis system as in claim 32 wherein the attack signal includes components of a frequency higher than those capable of being generated in the closed loop.

35. A tone synthesis system as in claim 32 wherein the attack signal has a duration less than the duration of the output of the closed loop in response to any excitation signal, whereby the attack signal is a component of only an initial portion of a synthesized tone and thereafter the synthesized tone is derived solely from the closed loop.

36. A tone synthesis system as in claim 31, wherein said attack means generates said attack signal independent from said closed loop.

* * * * *